United States Patent [19]

Costales et al.

[11] 4,023,340

[45] * May 17, 1977

[54] RING DRIVE CLUTCH LEVER

[76] Inventors: Manuel Costales; Moustafa I. Hakki, both of P.O. Box 884, Belmont, N.C. 28012

[ * ] Notice: The portion of the term of this patent subsequent to June 12, 1990, has been disclaimed.

[22] Filed: June 23, 1975

[21] Appl. No.: 589,390

[52] U.S. Cl. ..... 57/75; 57/105; 57/124

[51] Int. Cl.[2] ..... D01H 7/58

[58] Field of Search ..... 57/75, 77.45, 102–105, 57/124, 119

[56] References Cited

UNITED STATES PATENTS

| | | | |
|---|---|---|---|
| 3,098,345 | 7/1963 | Kramer et al. | 57/102 |
| 3,098,346 | 7/1963 | Steichele | 57/103 |
| 3,738,094 | 6/1973 | Costales et al. | 57/75 |
| 3,753,343 | 8/1973 | Naylor et al. | 57/77.45 |
| 3,788,056 | 1/1974 | Burri | 57/77.45 |
| 3,820,317 | 6/1974 | Raschle | 57/77.45 X |
| 3,871,166 | 3/1975 | Murakami et al. | 57/77.45 |
| 3,878,672 | 4/1975 | Kohler | 57/77.45 |

*Primary Examiner*—John Petrakes
*Attorney, Agent, or Firm*—Wendell Coffee

[57] ABSTRACT

The engagement of a rotating drive for the ring of a spinning machine, as seen in U.S. Pat. No. 3,738,094, is improved by placing the drive disc upon a pivoted block, which is controlled by a pitman and a cam lever working against a steel plate.

7 Claims, 3 Drawing Figures

RING DRIVE CLUTCH LEVER

BACKGROUND OF THE INVENTION

1. Field of the Invention

This invention relates to textile machines for spinning, twisting and twining, and more particularly for machines with rotating rings. 2. Description of the Prior Art Previous workers in the art have suggested the ring of spinning machine be rotated, we previously patented a machine having a rotating ring, U.S. Pat. No. 3,738,094. In this previous patent, a drive disc was upon a block, which was mounted with tongue and groove for sliding movement toward and away from the ring. In our previous patent, the adjustment of tension between the drive disc and the ring was by rotating a threaded pitman in a tap hole within the block upon which the disc was mounted.

SUMMARY OF THE INVENTION

New and Different Function

According to this invention, we have provided a better pitman with cam lever so the entire model operates more smoothly and effectively. The construction cost is less and the life is longer, according to this new development.

Objects of this Invention

An object of this invention is to spin or twist fibrous yarns for a continuous filament.

Another object is to provide an improved clutch for a spinning machine with a rotating ring.

Other objects are to achieve the above with a device that is sturdy, compact, durable, lightweight, simple, safe, efficient, versatile, durable, long life, and reliable, yet inexpensive and easy to manufacture, install, adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 1:
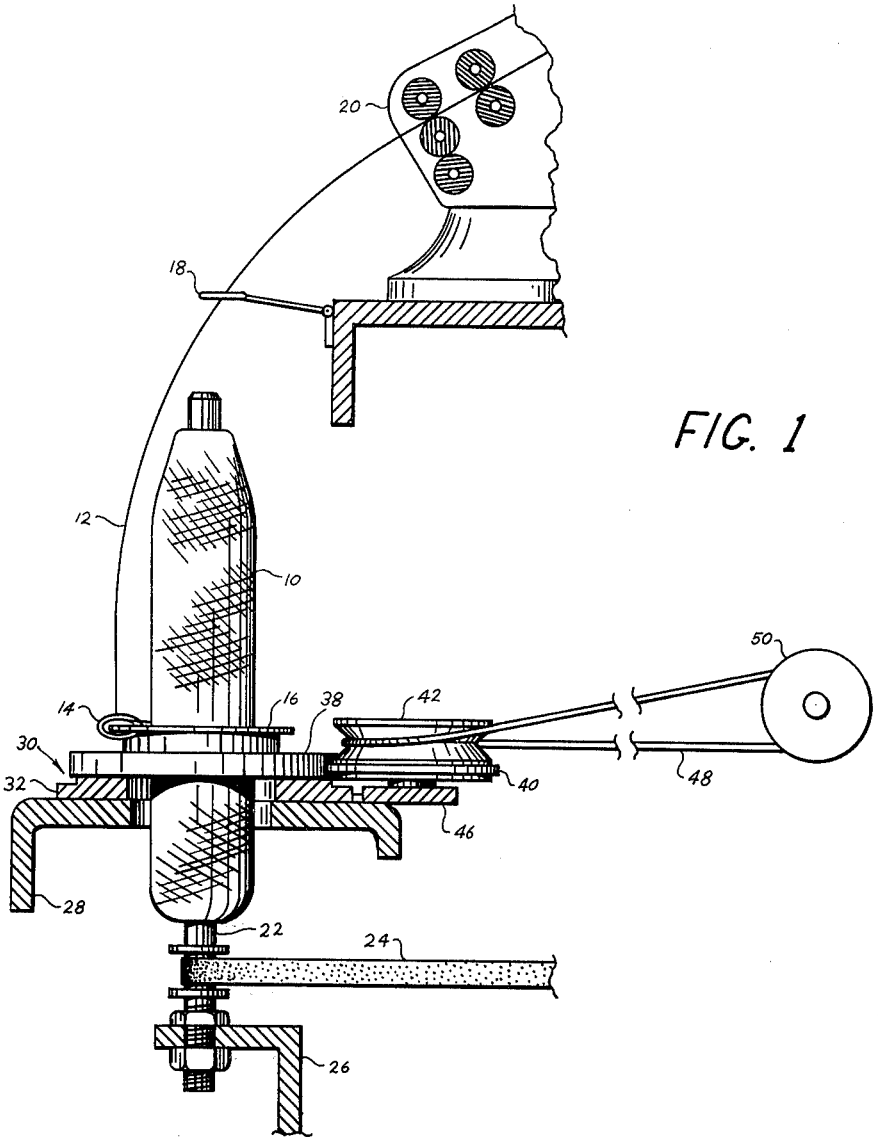
FIG. 1 is a sectional view showing a spinning machine with an embodiment of our invention attached thereto.

Referring more particularly to the drawing, there may be seen illustrated a conventional spinning machine in many respects. Specifically, the drawings illustrate bobbin 10 with yarn 12 being wound thereon. The yarn extends through traveler 14 upon ring 16 from thread guide 18 and draw works 20. The bobbin 10 is mounted upon spindle 22 which is driven by band 24. The spindle is mounted upon spindle rail 26. The ring 16 is mounted upon ring rail 28.

The attachment 30, which we have previously patented, includes rectangular base 32 having provisions for screws to attach it to the ring rail 28. For manufacturing reasons and, also, weight reasons, the base 32 is made of aluminum, plastic, or any light material. Thus, the total weight of the ring rail 28 with all that is attached to it is not substantially changed. Therefore, the attachment may be added to existing machines without substantially changing the balance of the ring rail, which can be easily adjusted.

Ring bearing 36 is secured within a central aperture of the base 32. The securing of ring bearing 36 within the base 32 is not described except that it is noted that the base 32 is split and has screw 34 holding it together to readily clamp a portion of the bearing 36 into place. Ring 16 is journaled within the ring bearing 36. Peripheral flange or band 38 upon ring bearing 36 drives the ring 16. The ring 16 is driven by being attached onto the bearing which is driven by the frictional band 40 upon drive disc 42. The drive disc 42 is mounted upon pivot block 46. It may be readily seen that as the pivot block 46 is moved toward or away from the band 38, the ring 16 will be driven or not driven. Those skilled in the art will understand that it is highly desirable to disengage the drive to the ring 16 upon certain occasions, not the least of which is to piece-up a down end. The pivot block 46 with the disc 42 is pulled away from the band 38 by the tension in the elastic drive cord or drive belt 48 which extends back to drive pulley 50, all as described in our previous patent referred to above. In addition, spring 51 between the block 46 and the base 32 urges the block and base apart.

Steel plate 52 is attached to the front of base 32 by screw 54. The base 32 has a groove 56 of rectangular cross section extending along one side. Pitman 58 has a rectangular cross section which fits within the groove 56 and forms a sliding fit therein. The pitman has a circular end 60 on the forward end which extends through hole 62 in the plate 52. Cam lever 64 is attached to the circular end 60 by pin 66. The cam lever 64 is also constructed of aluminum, plastic, or other light material. The back end 68 of the pitman 58 is of circular cross section and is threaded at 70 upon the extreme end to receive locking nut 72. The spring 51 surrounds the round end 68 of the pitman. The end 68 extends through circular hole 74 in a leg upon the pivot block 46. The hole 74 extends through the leg which extends outward from the main portion of the block 46 so the hole 74 is in alignment with the groove 56. The disc 42 is mounted upon a bearing 44 and is attached to the block 46 by bolt 76 extending through the bearing 44. The pivot block 46, itself, is pivoted by countersunk screw 78 to ear 80 attached to the back of the base 32.

Figure 2:
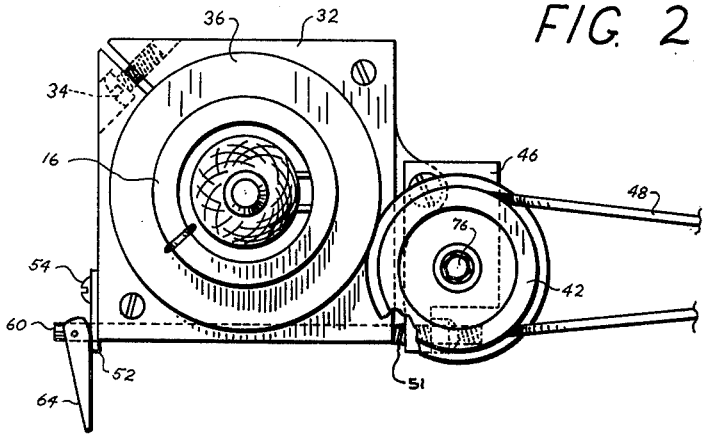
FIG. 2 is a top plan view of the attachment the embodiment.
Figure 3:
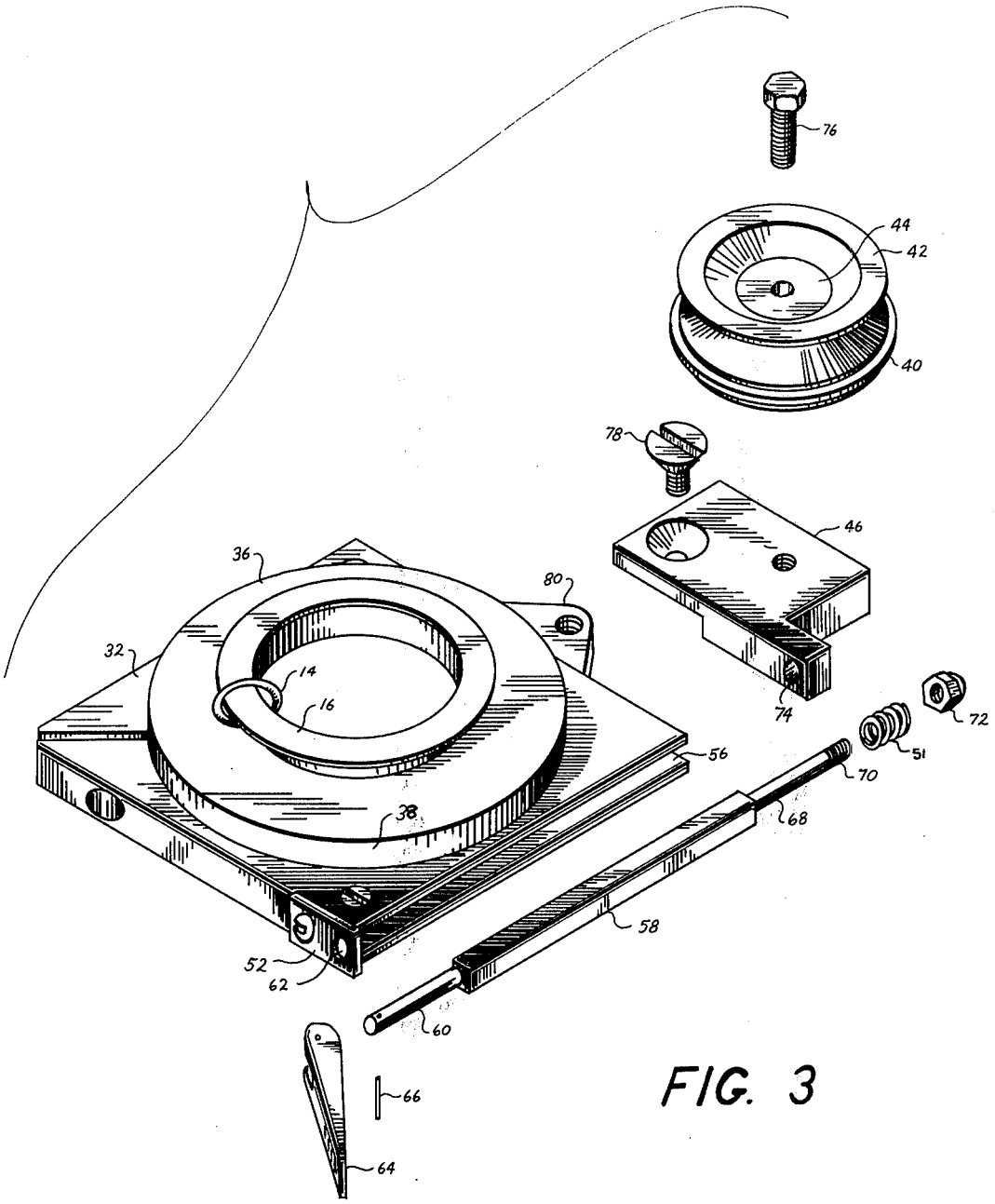
FIG. 3 is an exploded view of the embodiment.

Therefore, it may be seen that the tension by which the friction band 40 bears against the flange 38 is readily adjustable by adjusting the nut 72 upon the end of the pitman 58. To make this adjustment, the rotation of the pitman 58 is not necessary. Also, when the cam lever 64 is up in the horizontal position, the tension of the belt 48 and the spring 51 will pull pivot block 46 so the mechanism is not engaged, but when the lever is in the down position, as illustrated in FIG. 2, it will pull elements into tight driving contact. Further, it will be appreciated by those skilled in the art that the continual working of the toggle lever 64 upon the steel plate 52 will not result in galling, but will continue to work freely even though it is free of lubrication. Also, those skilled in the art will understand that the lock nuts 72 have fibrous elements within them so the vibration does not change positions.

The embodiment shown and described above is only exemplary. We do not claim to have invented all the parts, elements or steps described. Various modifications can be made in the construction, material, arrangement, and operation, and still be within the scope our invention. The limits of the invention and the bounds of the patent protection are measured by and defined in the following claims. The restrictive description and drawing of the specific example above do not point out what an infringement of this patent would be, but are to enable the reader to make and use the invention.

In this application, we claim as our invention:

1. In a machine having a. bobbins, b. bobbin drive means on the machine for rotating the bobbins at high speed, c. a light weight base around each bobbin, d. a ring on the base around each bobbin, e. each ring mounted for rotation on its base, f. a traveler on each ring, g. means for feeding yarn to each bobbin via the traveler, h. a disc mounted for rotation, j. an elastic belt around the disc for rotating same, and k. a friction band on the disc contacting the ring;

m. the improved structure for moving each of the discs toward and away from the ring comprising:

n. a pivot block pivoted to the base, o. said disc rotationally mounted on the pivot block, p. a pitman extending from behind the pivot block to in front of the base, q. a steel plate attached to the front of the base, r. a hole in the plate, s. the pitman extending through the hole in the plate, t. a cam lever on the pitman in front of the plate, u. so that the pivot block and thus the disc may be moved toward and away from the ring by the cam lever.

2. The invention as described in claim 1 with an additional limitation of v. a spring around the pitman between the block and base, urging them apart.

3. In a machine having a. bobbins, b. bobbin drive means on the machine for rotating the bobbins at high speed, c. a base around each bobbin, d. a ring on the base around each bobbin, e. each ring mounted for rotation on its base, f. a traveler on each ring, g. means for feeding yarn to each bobbin via the traveler, h. a disc mounted for rotation, j. an elastic belt around the disc for rotating same, and k. a friction band on the disc contacting the ring;

m. the improved structure for moving each of the discs toward and away from the ring comprising:

n. a pivot block pivoted to the base, o. said disc rotationally mounted on the pivot block, p. a pitman extending from behind the pivot block to in front of the base, g. said pitman threaded behind the pivot block, r. a nut threaded to the pitman behind the pivot block, s. a cam lever in front of the base, t. so that the pivot block and thus the disc may be moved toward and away from the ring by the cam lever, and the pressure of the friction band to the ring may be adjusted by the nut, u. said base is made of a light weight material, and v. a steel plate is attached to the front of the base, w. a hole in the plate, x. said pitman extending through said hole in the plate and said cam lever bearing against said plate.

4. The invention as defined in claim 3 with additional limitations of u. a leg on the pivot block, v. a hole in the leg, w. said pitman extending through the hole in the leg and said nut bearing against the back of the leg.

5. The invention as defined in claim 3 with an additional limitation of u. a spring between the base and block urging them apart.

6. The invention as defined in claim 5 with additional limitations of v. a leg on the pivot block, w. a hole in the leg, x. said pitman extending through the hole in the leg and said nut bearing against the back of the leg.

7. The invention as defined in claim 6 with additional limitations of y. said base is made of a light weight material, and z. a steel plate is attached to the front of the base, aa. a hole in the plate, bb. said pitman extending through said hole in the plate and said cam lever bearing against said plate.

* * * * *